US005326239A

United States Patent [19]

Fujiwara et al.

[11] Patent Number: 5,326,239

[45] Date of Patent: Jul. 5, 1994

[54] FLUID COMPRESSOR HAVING A HORIZONTAL ROTATION AXIS

[75] Inventors: Takayoshi Fujiwara, Kawasaki; Hisanori Honma, Yokohama, both of Japan

[73] Assignee: Kabushiki Kaisha Toshiba, Kawasaki, Japan

[21] Appl. No.: 10,874

[22] Filed: Jan. 29, 1993

[30] Foreign Application Priority Data

Jan. 31, 1992 [JP] Japan ..... 4-16121
Feb. 10, 1992 [JP] Japan ..... 4-23580

[51] Int. Cl.[5] ..... F01C 21/04

[52] U.S. Cl. ..... 418/88; 418/94; 418/220

[58] Field of Search ..... 418/88, 91, 94, 220

[56] References Cited

U.S. PATENT DOCUMENTS 4,568,253 2/1986 Wood ..... 418/94
4,871,304 10/1989 Iida et al. ..... 418/220
4,872,820 10/1989 Iida et al. ..... 418/220
4,875,841 10/1989 Iida et al. ..... 418/220
4,875,842 10/1989 Iida et al. ..... 418/220
4,983,108 1/1991 Kawaguchi et al. ..... 418/88
5,060,759 10/1991 Dussourd et al. ..... 418/88

*Primary Examiner*—Richard A. Bertsch
*Assistant Examiner*—Charles G. Freay
*Attorney, Agent, or Firm*—Cushman, Darby & Cushman

[57] ABSTRACT

There is provided a fluid compressor having a horizontal rotation axis. An oil reservoir for a lubrication oil is provided within a sealed casing. A cylinder having both end opening portions rotatably supported by bearings is housed within the casing. A rotor piston is eccentrically supported within the cylinder. A helical blade is wound around the outer periphery of the piston such that it can project from and retreat in the outer periphery of the piston. The cylinder and the piston are coupled by an Oldham mechanism. A gas is taken in a compression chamber defined by the cylinder, piston and blade, and it is compressed. The compressor is provided with a pump member, e.g. a trochoid pump, actuated by the rotation of the piston. The lubrication oil is sucked from the oil reservoir and supplied to slide portions.

7 Claims, 6 Drawing Sheets

FLUID COMPRESSOR HAVING A HORIZONTAL ROTATION AXIS

BACKGROUND OF THE INVENTION

1. Field of the Invention

The present invention relates to a fluid compressor having a horizontal rotation axis, used in, e.g. a refrigeration apparatus, for sucking and compressing a low-pressure refrigerant gas and discharging a high-pressure refrigerant gas.

2. Description of the Related Art

Conventionally, there is known a horizontal fluid compressor used in, e.g. a refrigeration apparatus.

In this type of compressor, a rotor having a horizontal axis is housed within a horizontally elongated sealed casing.

An oil reservoir for a lubrication oil is formed at an inner bottom portion of the sealed casing. There is provided an oil supply device for sucking the lubrication oil from the oil reservoir in accordance with the rotation of the rotor, and supplying the oil to a compression mechanism provided at the rotor.

In a normal vertical compressor, a rotor extends vertically and its lower end portion is immersed in a lubrication oil in an oil reservoir formed at an inner bottom portion of a sealed casing. Thus, an oil supply device of this compressor can easily and surely suck the lubrication oil by utilizing a centrifugal force produced by the rotation of the rotor, and can supply the oil to a compression mechanism.

However, in the horizontal fluid compressor. The axis of the motor is horizontal and parallel to the level of the lubrication oil in the oil reservoir, and a considerable distance may be provided between the rotor and the level of the lubrication oil, depending on the compression capacity of the compressor.

Thus, n particular, the horizontal fluid compressor needs to be provided with a highly reliable oil supply device for surely sucking up the lubrication oil.

An example of the horizontal fluid compressor is a so-called helical blade fluid compressor which has a relatively simple structure and a high sealing property, and realizes high efficiency compression and easy manufacture and assembly of parts.

FIG. 14 shows an example of an oil supply device of this horizontal fluid compressor.

A lower end opening portion of an oil suck-up pipe 102 is immersed in a lubrication oil in an oil reservoir 101 formed at an inner bottom portion of a sealed casing 100.

By the influence of high-pressure gas discharged into the sealed casing 100, the level of the lubrication oil in the oil reservoir 101 is pushed and the oil is sucked up through the oil suck-up pipe 102.

The sucked-up oil is led to an oil supply port 105 formed axially in a rotor piston 104 via a space defined between a bearing 103 and an end face of a shaft portion of the rotor piston 104. The oil supply port 105 communicates with the bottom of a helical groove (not shown) along which a blade is wound. The lubrication oil is supplied to a chamber defined between the blade and the bottom of the groove.

The oil is further supplied to various parts of the compression mechanism, e.g. a slide portion between the blade and the helical groove, a slide portion between the blade and a cylinder 106, and slide portions between the bearing 103, on the one hand, and the cylinder 106 and rotor piston 104, on the other hand. Thus, smooth operation of the compression mechanism is ensured.

This oil supply device, however, has the following problems.

The lubrication oil in the oil reservoir 101 is sucked up through the oil suck-up pipe 102 by the pressure difference between the gas pressure within the sealed casing 100, into which the high-pressure refrigerant gas is discharged, and the pressure in the chamber defined by the bottom of the helical groove (i.e. the outlet of the oil supply port 105) and the blade. The position of the outlet of the oil supply port 105 is determined such that the pressure in the chamber is an intermediate pressure between the discharge pressure of the refrigerant gas and the sucking pressure.

However, the lubrication oil supplied to the chamber is led to a compression chamber defined by the blade, and in this compression chamber the oil is compressed along with the refrigerant gas. Thus, because of oil compression action, a great load is likely to occur and compression efficiency decreases.

In addition, when the compressor is stopped, the lubrication oil returns to the sucking portion owing to the pressure difference between the pressure in the chamber (i.e. The outlet of the oil supply port 105) and the pressure in the oil sucking portion.

Consequently, at the re-start time, much time is needed to supply the lubrication oil to the respective slide portions, and oil supply to, e.g. an Oldham mechanism, becomes inadequate.

When the lubrication oil reaches the compression chamber from the outlet of the oil supply port 105, the oil compression action occurs once again and a great load acts. This being the case, the reliability of this oil supply device is low.

SUMMARY OF THE INVENTION

The object of the present invention is to provide a fluid compressor having a horizontal rotation axis with oil supply means, wherein a sufficient amount of oil can always be maintained to enhance lubrication properties, oil compression and occurrence of high load can be prevented, flowing back of the lubrication oil can be prevented at the time of stopping the compressor, and oil compression at the time of re-start can be avoided, thereby achieving high reliability.

According to the present invention, there is provided a fluid compressor having a horizontal rotation axis comprising:

a sealed casing;

an oil reservoir, formed at an inner bottom portion of the sealed casing, for receiving a lubrication oil;

a rotor situated within the sealed casing and supported with its axis situated horizontally, in parallel to the level of the lubrication oil in the oil reservoir at a predetermined distance kept between the rotor and the level of the lubrication oil;

a motor unit, provided on the rotor, for rotating the rotor;

a compression mechanism, provided on the rotor, for sucking, compressing and discharging a fluid to be compressed, in accordance with the rotation of the rotor; and oil supply means, provided on the rotor, for sucking the lubrication oil from the oil reservoir by utilizing a torque of the rotor as a driving force, and forcefully supplying the lubrication oil to a discharge-side slide portion of the compression mechanism.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 3 show an embodiment of the present invention, in which

FIG. 1 is a cross-sectional view of a fluid compressor,

FIG. 2 is an enlarged view of an oil supply device in the fluid compressor and a peripheral portion thereof, and FIG. 3 shows the structure of a trochoid pump functioning as an oil supply device;

FIGS. 4 to 13 show another embodiment of the invention, in which

FIG. 4 is an enlarged view of an oil supply device and a peripheral portion thereof, FIG. 5 is a vertical cross-sectional view of a fluid compressor having an oil supply device of a different structure, FIG. 6 is an enlarged, exploded view of the oil supply device of FIG. 5, FIG. 7 is a vertical cross-sectional view of a fluid compressor of a different structure, FIG. 8 is a vertical cross-sectional view of an oil supply device of a different structure, FIG. 10 is a side view of a shaft portion and a blade which are parts of the oil supply device, FIG. 11 is an exploded view of the shaft portion and the blade, FIG. 12 is a vertical cross-sectional view of an oil supply device of another structure.

DETAILED DESCRIPTION OF THE PREFERRED EMBODIMENT

A fluid compressor according to an embodiment of the present invention will now be described with reference to the accompanying drawings. This compressor is used as part of a refrigeration apparatus.

Figure 1:
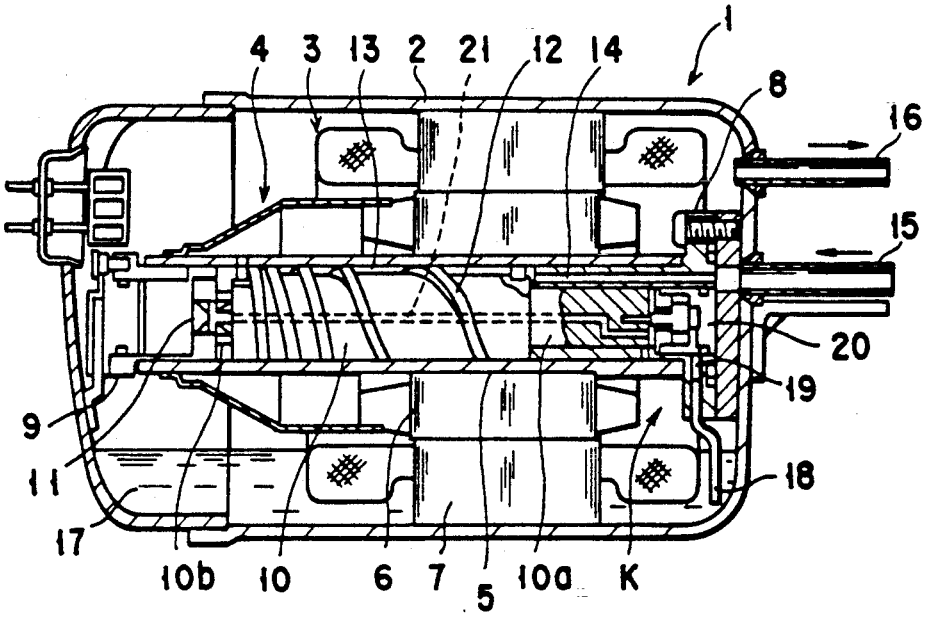

As is shown in FIG. 1, a compressor body 1 is horizontally elongated, and comprises a horizontal sealed casing 2 with sealed both end portions, and a motor unit 3 and a compression mechanism 4 both housed within the sealed casing 2.

The compression mechanism 4 has a hollow cylinder 5. A rotor 6, which is part of the motor unit 3, is fitted on the outer periphery of the cylinder 5.

The rotor 6 and the cylinder 5 are concentric.

A stator 7 fixed on the inner periphery of the sealed casing 2 is situated around the rotor 6. The rotor 6 and the stator 7 constitute the motor unit 3.

A main bearing 8 fixed on one-side wall of the sealed casing 2 is fitted in one-side opening portion of the cylinder 5 hermetically and loosely.

A sub-bearing 9 fixed on the other-side wall of the sealed casing 2 is fitted in the other-side opening portion of the cylinder 5 hermetically and loosely.

Specifically, the cylinder 5 with its axis situated horizontal is housed within the sealed casing 2. Both end portions of the cylinder 5 are rotatably supported by the main bearing 8 and sub-bearing 9.

A solid-cylindrical rotor piston 10 is situated within the inner space of the cylinder 5 along the axis of the cylinder 5.

The center axis of the rotor piston 10 is eccentric to the center axis of the cylinder 5 to a certain degree. Part of the outer periphery of the rotor piston 10 is put in contact with the inner periphery of the cylinder 5 along the axis of the cylinder 5.

The main bearing 8 rotatably supports a first shaft portion 10*a* of the rotor piston 10. The sub-bearing 9 rotatably supports a second shaft portion 10*b* of the rotor piston 10.

An Oldham mechanism 11 functioning as driving means is provided at one end of the rotor piston 10.

The Oldham mechanism 11 couples the cylinder 5 and rotor piston 10 and transmits a torque of the cylinder 5 to the rotor piston 10 when the cylinder 5 is rotated, such that the cylinder 5 and rotor piston 10 are simultaneously rotated at different circumferential velocities.

The specific structure of the Oldham mechanism 11 is disclosed in detail in the applicant's previous Japanese Patent Application No. 2-96305.

A helical groove (not shown) is formed in the outer periphery of the rotor piston 10 between both shaft portions 10*a* and 10*b*. The pitch of the helical groove decreases gradually from the first shaft portion 10*a* towards the second shaft portion 10*b*.

A helical blade 12 having a thickness substantially equal to the width of the groove is fitted in the groove.

The blade 12 is formed of a very smooth material such as fluororesin or synthetic resin, other than metals. Such a material has a less specific gravity and a less amount of imbalance than a metal material.

The blade 12, over its entire length, can project from and retreat in the groove in the radial direction of the rotor piston 10. The outer periphery of the blade 12 can slide over the inner periphery of the cylinder 5 while the former is in close contact with the latter.

The space between the inner periphery of the cylinder 5 and the outer periphery of the rotor piston 10 is divided into a plurality of compression chambers 13 by the blade 12.

In accordance with the pitch of the groove, the volumes of the compression chambers 13 decrease from one end of the rotor piston 10 towards the other end.

An axially extending suction port 14 is formed in the main bearing 8 in parallel to a support portion for the shaft portion 10*a*. One end opening portion of the suction port 14 communicates with a suction tube 15 connected to the sealed casing 2.

The suction tube 15 communicates with an evaporator (not shown) which is a component of the refrigeration apparatus.

The other end opening portion of the suction port 14 is open to the inside of the cylinder 5.

A discharge tube 16 communicating with a condenser (not shown), which is a component of the refrigeration apparatus, is connected to that part of the sealed casing 2 which is above the suction tube 15.

An oil reservoir 17 for receiving a lubrication oil is formed at an inner bottom part of the sealed casing 2.

The lubrication oil in the oil reservoir 17 is sucked up by an oil supply device K or oil supply means (described later) and supplied to the compression mechanism 4.

Specifically, a lower end portion of an oil suck-up pipe 18 is immersed in the lubrication oil in the oil reservoir 17. An upper end portion of the suck-up pipe 18 is connected to an oil suck-up port 19 formed in the main bearing 8.

A pump unit 20 communicating with the oil suck-up port 19 is provided at an end portion of the main bearing 8. An axially extending oil supply port 21 is formed in the rotor piston 10 from the end face of the first shaft portion 10*a* to the end face of the second shaft portion 10*b*.

An opening end portion of the oil supply port 21 in the first shaft portion 10*a* faces the pump unit 20, and an opening end portion of the oil supply port 21 in the second shaft portion 10*b* faces the Oldham mechanism 11.

The end portion of the oil supply port 21 facing the pump unit 20 is situated eccentric to the center axis of the rotor piston 10 at the end face of the shaft portion 10*a*, and the oil supply port 21 extends from the end face of the shaft portion 10*a*. At a chosen point, the oil supply port 21 is bent to reach a point located along the axis of the rotor piston 10.

Figure 2:
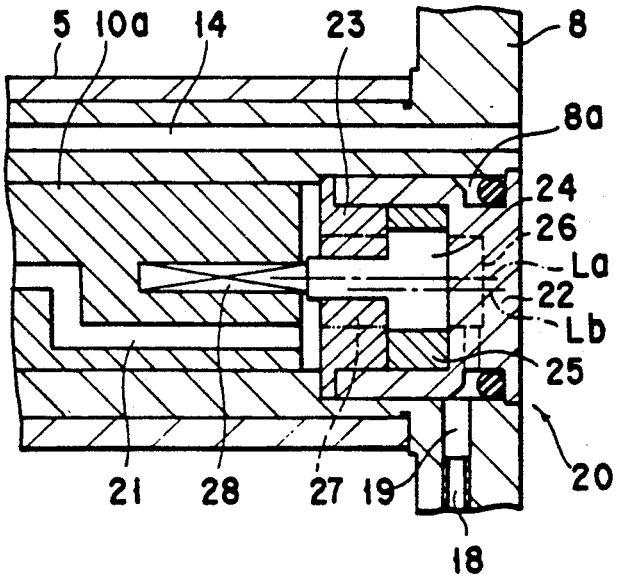
Figure 3:
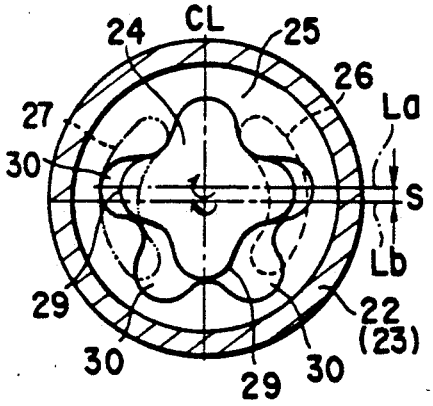

FIGS. 2 and 3 are enlarged views of the pump unit 20.

The pump unit 20 has a trochoid pump structure. An inner gear 24 and an outer gear 25 are contained between a suction cover 22 and a discharge cover 23. The inner gear 24 and outer gear 25 are rotatable and eccentric to each other, and in addition the gears 24 and 25 are partially meshed with each other.

The suction cover 22 with a sealing structure is hermetically fitted in an inner cavity 8*a* of the main bearing 8 by means of a rotation-preventing mechanism (not shown).

The suction cover 22 is provided with a suction port 26 communicating with the oil suck-up port 19. As is shown in FIG. 3, the suction portion 26 has an arcuated shape and is located on one side (the right part in FIG. 3) of a vertical axis CL, as viewed from the end face of the main bearing 8.

The discharge cover 23 is fitted in the main bearing 8 by means of a rotation-preventing mechanism (not shown). The discharge cover 23 is provided with an arcuated discharge port 27 located on the other side (the left part in FIG. 3) of the vertical axis CL, as shown in FIG. 3.

A fixing rod 28 is provided on one side face of the inner gear 24. The rod 28 is tightly inserted into the rotor piston shaft portion 10*a*. The inner gear 24 is rotatable with the rotor piston 10 as one unit.

In FIGS. 2 and 3, the center axis La of the inner gear 24 is situated higher than the center axis Lb of the outer gear 25 by a degree s of eccentricity.

The inner gear 24 has four teeth 29 arranged circumferentially at regular intervals.

The inner periphery of the outer gear 25 is provided with five recesses 30 arranged circumferentially at irregular intervals.

The configuration and meshing state of the recesses 30 and teeth 29 of the inner gear 24 may be identical to those of an ordinary trochoid pump.

The operation of the above-described fluid compressor will now be described.

The motor unit 3 is activated to rotate the cylinder 5. A torque of the cylinder 5 is transmitted to the rotor piston 10 via the Oldham mechanism 11. The rotor piston 10 is rotated with its part kept in contact with the inner periphery of the cylinder 5, and the blade 12 is rotated with the piston 10 as one unit.

Since the blade 12 is rotated with its outer peripheral surface put in contact with the inner periphery of the cylinder 5, the blade 12 retreats in the groove as it approaches a contact portion between the outer periphery of the rotor piston 10 and the inner periphery of the cylinder 5. And the blade 12 projects from the groove as it goes away from the contact portion.

On the other hand, a low-pressure refrigerant gas is introduced from the evaporator (not shown) into the suction port 14 through the suction tube 15, and the gas is taken in one compression chamber 13 defined between the opening end of the suction port 14 and one-end portion of the cylinder 5.

The refrigerant gas taken in the compression chamber 13 is conveyed as the compression chamber 13 moves in accordance with the rotation of the rotor piston 10.

By virtue of the set pitch of the blade 12, the volume of the compression chamber 13 decreases as it moves. The gas in the chamber 13 is gradually compressed and pressurized.

When the compression chamber 13 moves to the discharge portion, the compressed gas is pressurized to a predetermined level.

The high-pressure gas is discharged to the inside space of the sealed casing 2 from the compression chamber 13 which has moved to the discharge portion In this manner, in accordance with the rotation of the cylinder 5 and rotor piston 10, the compression chamber 13 located at the suction portion sucks the low-pressure gas successively, and the gas is conveyed and compressed and discharged to the inside space of the sealed casing 2.

The sealed casing 2 is filled with the high-pressure gas, and the gas is led to the condenser (not shown) through the discharge tube 16.

The pressure of the high-pressure gas filled in the sealed casing 2 acts on the level of the lubrication oil in the oil reservoir 17, and part of the lubrication oil is sucked up through the suck-up pipe 18.

On the other hand, the pump unit 20 is driven by the rotation of the rotor piston 10, and the suck-up function of the lubrication oil is facilitated.

In the pump unit 20, the inner gear 24 which rotates with the rotor piston 10 as one unit functions as a prime driver. The teeth 29 of the inner gear 24 are engaged with the recesses 30 of the outer gear 25, thereby rotating the outer gear 25.

The lubrication oil introduced from the suction port 26 is pressurized in the spaced defined between the teeth 29 and the recesses 30, as the gears 24 and 25 rotate and the volume of the space between the teeth 29 and recesses 30 varies. Thus, the pressurized lubrication oil is led to the discharge port 27.

The pressurized lubrication oil is discharged from the pump unit 20. The pressurized lubrication oil is led through the oil supply port 21 and supplied to the Oldham mechanism 11 from the opening end of the supply port 21. Thus, smooth operation of the Oldham mechanism 11 is ensured.

The Oldham mechanism 11 is a slide portion provided on the gas discharge side of the compression chamber 13. The oil is forcefully supplied to the Oldham mechanism directly from the pump unit 20.

The lubrication oil is dispersed by the Oldham mechanism 11 and supplied to slide portions between the groove and blade 12; between the blade 12 and cylinder 5; between the cylinder 5, on the one hand, and the main bearing 8 and sub-bearing 9, on the other hand; and between both shaft portions 10*a* and 10*b* of the rotor piston 10, on the one hand, and the support portions of the main bearing 8 and sub-bearing 9, on the other hand.

The lubrication oil is surely and stably supplied to the slide portions of the compression mechanism 4. Thereby, lubrication of the slide portions is ensured and wear resistance is enhanced.

In addition, by supplying the lubrication oil directly to the Oldham mechanism 11 (i.e. gas-discharge side slide portion), no oil compression action occurs in the compression chamber 13, and no great load arises.

When the compressor is stopped, the lubrication oil does not flow back from the pump unit 20, and no oil compression action occurs at the re-start time.

Figure 4:
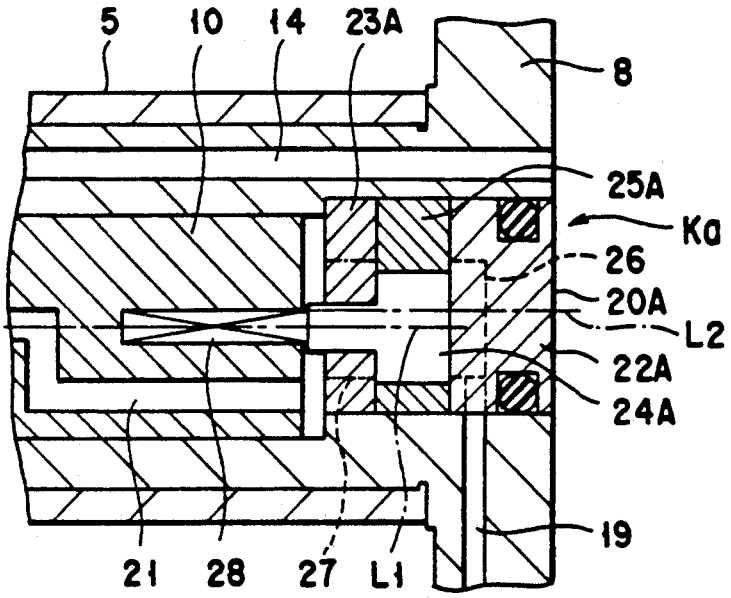

It is also possible to employ an oil supply device Ka having a trochoid pump structure as shown in FIG. 4.

The fixing rod 28 is provided on one side face of an inner gear 24A, and it is tightly inserted into the rotor piston 10. The center axis L1 of the inner gear 24A coincides with the center axis L1 of the rotor piston 10.

The center axis L2 of an outer gear 25A coincides with the center axis L2 of the cylinder 5, and an outer peripheral portion of the gear 25A is rotatably fitted in the main bearing 8. The center axis L2 of the main bearing 8 coincides with the center axis L2 of the outer gear 25A and cylinder 5.

On the other hand, the center axis L2 of the cylinder 5 is eccentric to the center axis L1 of the rotor piston 10. Thus, the center axis L1 of the inner gear 24A is eccentric to the center axis L2 of the outer gear 25A by the same degree.

Recesses are formed in the inner periphery of the outer gear 25A at irregular intervals. The configuration and meshing state of the recesses and teeth of the inner gear 24A may be identical to those of an ordinary trochoid pump.

In this oil supply device Ka, the center axis L1 of the inner gear 24A coincides with the center axis L1 of the rotor piston 10, and the center axis L2 of the outer gear 25A coincides with the center axis L2 of the cylinder 5. Thus, eccentric machining is not required in machining the inner cavity of the main bearing 8 which serves as a positioning standard for the pump unit 20A, and the number of manufacturing steps can be reduced.

The outer gear 25A can be assembled with simple positioning, without using a suction cover 22A. The configurations of the suction cover 22A and discharge cover 23A can be simplified.

In the above embodiments, the oil supply devices of trochoid pump structure is used as oil supply means. However, the pump structure is not limited to this, and a pump of a structure described below can be used.

Figure 5:
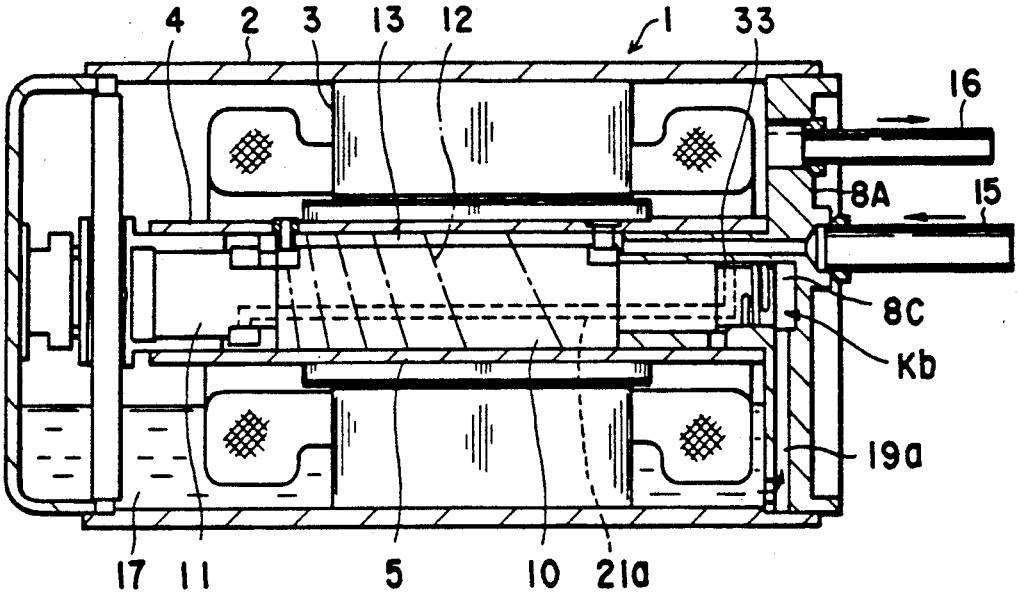

FIG. 5 shows a fluid compressor having an oil supply device Kb.

The structure of this fluid compressor is basically identical to that of the fluid compressor shown in FIG. 1, except the oil supply structure described below. The basic parts are denoted by like reference numerals, and a new description thereof is not given.

Figure 6:
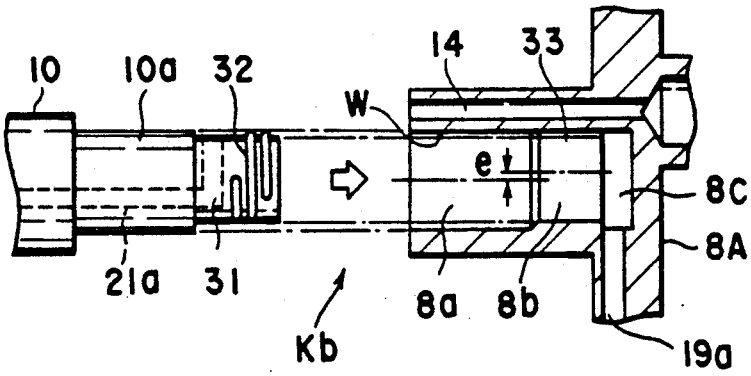

FIG. 6 shows the details of the oil supply device Kb.

The main bearing 8A includes an axially extending support portion 8*a*, an eccentric support portion 8*b* eccentric to the support portion 8*a* by a degree e, and an oil guide chamber 8*c* eccentric to the support portion 8*b* by a suitable degree.

At least the upper end portions W of the support portion 8*a* and eccentric support portion 8*b* are located at the same position.

On the other hand, the shaft portion 10*a* is provided with a winding portion 31 having a diameter less than that of the shaft portion 10*a*. A helical groove is formed in the winding portion 31, and a helical portion 32 is fitted in the groove so as to be radially movable (i.e. the helical portion 32 can project from and retreat in the groove). The diameter of the helical portion 32 is equal to that of the eccentric support portion 8*b*.

When the rotor piston shaft portion 10*a* is inserted in the support portion 8*a*, the winding portion 31 is inserted in the eccentric support portion 8*b*. Thus, an eccentric chamber 33 is defined between the periphery of the winding portion 31 and the periphery of the eccentric support portion 8*b*.

Part of the helical portion 32 projects to the eccentric chamber 33 and divides the chamber 33 into a plurality of closed chambers.

The main bearing 8A is provided with an oil suck-up path 19*a*.

As shown in FIG. 5, the oil suck-up path 19*a* has an opening end portion in the lubrication oil in the oil reservoir 17 formed at the lower end portion of the main bearing 8A. The suck-up path 19*a* extends vertically along the wall of the main bearing 8A. An upper opening portion of the suck-up path 19*a* communicates with the oil guide chamber 8*c*.

One end of the oil supply port 21*a* is open to a part of the periphery of the winding portion 31. The oil supply port 21*a* is bent at a center part of the winding portion 31 and extends axially in the rotor piston 10. The other end of the oil supply port 21*a* is open to the Oldham mechanism 11 (i.e. gas-discharge side slide portion).

Thus, in accordance with the rotation of the rotor piston 10, the helical portion 32 rotates with the piston 10 as one unit. By the influence of the high-pressure gas discharged to the inside of the sealed casing 2, the oil is sucked up from the oil reservoir 17 through the oil suck-up path 19*a* and temporarily collected in the oil guide chamber 8*c*.

By the rotation of the helical portion 32, the oil is successively led to the closed chambers of the eccentric chamber 33, pressurized, and discharged therefrom.

The pressurized lubrication oil is conveyed through the oil supply port 21*a*, and it is supplied from the opening end of the port 21*a* directly to the Oldham mechanism 11 which is the gas-discharge side slide portion. Further, the oil is supplied to the other slide portions, as in the above-described embodiments.

Since the oil supply function of the oil supply device Kb is based on the helical motion of the helical portion 32, the operation of the device Kb is sure and highly reliable. With a relatively simple structure, only the conventional parts of the fluid compressor may be machined, and only the helical portion 32 must be provided. Thus, the machining is relatively easy, and manufacturing cost is low.

Figure 7:
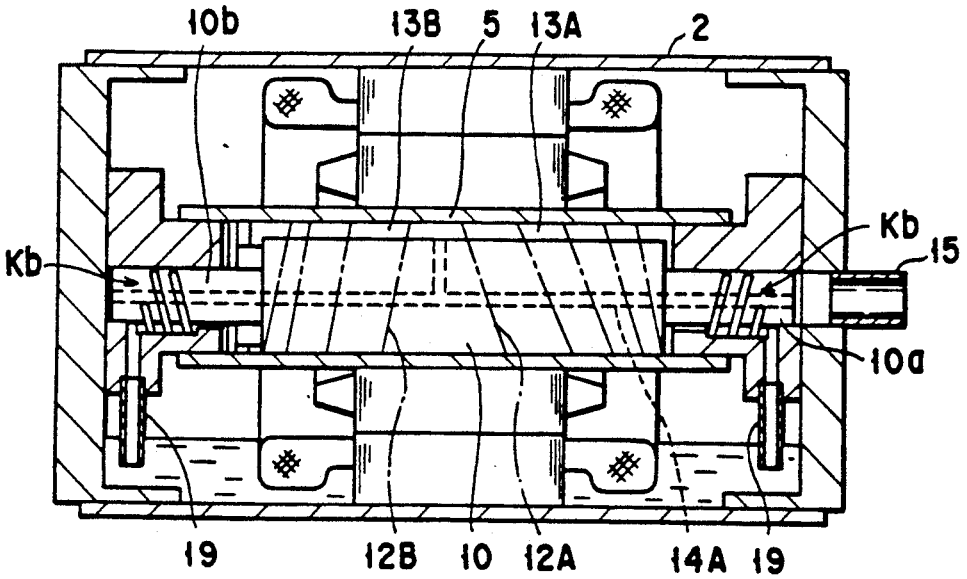

The oil supply device Kb of the same structure is applicable to a so-called twin-type fluid compressor, as shown in FIG. 7.

The rotor piston 1 of this compressor is provided with two blades 12A and 12B (indicated by dot-and-dash lines) which extend from the axial center point of the piston 10 in opposite directions.

The refrigerant gas sucked from the suction tube 15 is introduced through a gas suction port 14A extending axially in the rotor piston 10. The gas is discharged from the outer periphery of the rotor piston 10 at the axial center point.

Then, the refrigerant gas is supplied to the right and left chambers 13A and 13B defined by the right and left blades 12A and 12B and compressed successively.

The oil supply device Kb shown in FIGS. 5 and 6 (specifically, the structure of the oil suck-up path 19 (19*a*) varies but the function thereof is identical) is provided at each of the shaft portions 10*a* and 10*b* of the rotor piston 10.

In accordance with the rotation of the rotor piston 10, the two oil supply devices Kb are operated simultaneously. The oil supply devices Kb suck up the lubrication oil from the oil reservoir 17 and supply it directly to the gas-discharge side slide portion. Further, the oil is supplied to the other slide portions.

As described above, in the so-called twin-type compressor, the rotor piston 10 is provided with a pair of blades 12A and 12B and the compression operation is performed in the two compression chambers 13A and 13B. Even in the twin-type compressor, a sufficient amount of oil can be supplied to the slide portions and high lubrication properties can be achieved.

Figure 8:
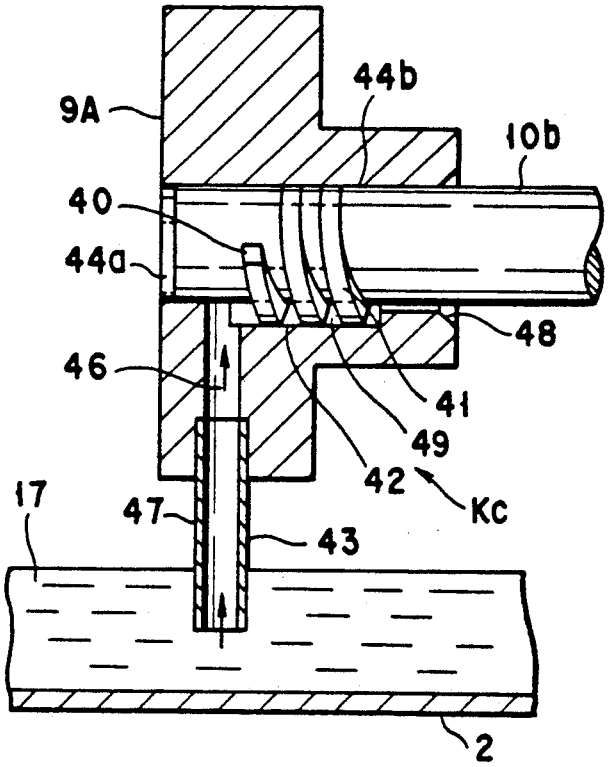
Figure 9A:
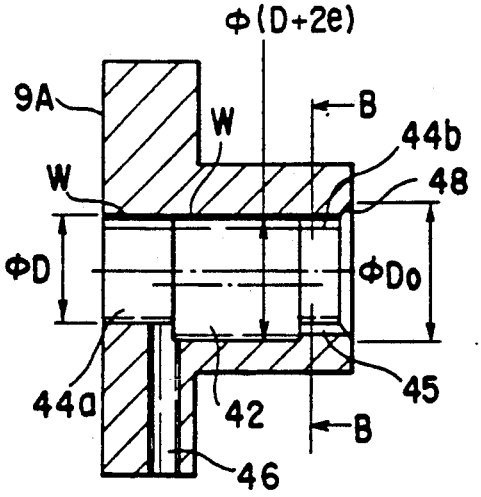
FIG. 9A is a vertical cross-sectional view of a sub-bearing of the oil supply device.
Figure 9B:
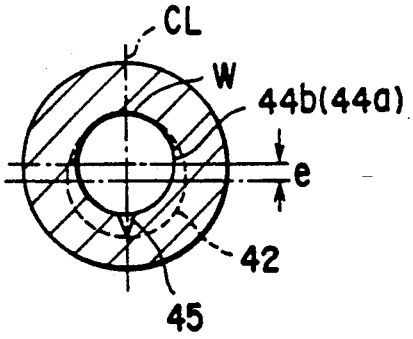
FIG. 9B is a vertical cross-sectional view taken along B—B in FIG. 9A.

It is also possible to use an oil supply device Kc as shown in FIGS. 8, 9A and 9B.

The oil supply device Kc is provided at the subbearing 9A, but it may be provided at the main bearing 8, where necessary.

The oil supply device Kc comprises a helical portion 41 radially movably fitted in a helical groove 40 formed in a part of a rotor piston shaft portion 10*b*, an eccentric support portion 42 provided in a sub-bearing 9A and containing the helical portion 41, and an oil suck-up path 43. The shaft portion 10*b* serves as a winding portion.

The eccentric support portion 42 is provided at the center of the sub-bearing 9A. One support hole 44*a* is provided on one side of the support portion 42, and the other support hole 44*b* is provided on the other side of the support portion 42.

The shaft portion 10*b* is rotatably supported in the support holes 44*a* and 44*b*, and the helical portion 41 projects to the eccentric support portion 42.

The axis of the eccentric support portion 42 is eccentric to the axis of the support holes 44*a* and 44*b* by a predetermined degree e.

The upper ends W of the support holes 44*a*, 44*b* and eccentric support portion 42, which intersect the vertical axis CL, coincide with each other. Accordingly, when the diameter of support holes 44*a*, 44*b* is $\phi D$, the diameter of the eccentric support portion 42 is $\phi(D+2e)$.

An oil guide groove 45 is provided only in the support hole 44*b*. The groove 45 has a V-cross section and it extends in a direction in which the eccentric support portion 42 is eccentric to the support hole 44*b*, that is, the groove 45 is situated in a position opposite to the upper ends W.

The upper end portion of an oil supply port 46 is open below a boundary area between the support hole 44*a* and eccentric support portion 42. The oil supply port 46 extends vertically and the lower end portion of the port 46 is open at the lower peripheral surface of the sub-bearing 9A.

The upper end portion of an oil suck-up pipe 47 is fitted in the oil supply port 46. The lower end portion of the oil suck-up pipe 47 is immersed in a lubrication oil in the oil reservoir 17 formed at the inner bottom portion of the sealed casing 2.

The oil suck-up pipe 47 and the oil supply port 46 constitute the oil suck-up path 43.

In the state in which the shaft portion 10*b* is supported in the support holes 44*a* and 44*b*, part of the shaft portion 10*b* penetrates the eccentric support portion 42, and an eccentric chamber 49 defined by the helical portion 41 between the peripheral surface of the eccentric support portion 42 and the peripheral surface of the shaft portion 10*b*.

Figure 10:
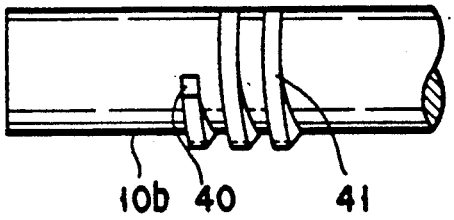

FIG. 10 shows the state in which the helical portion 41 is wound in the helical groove 40 formed in the shaft portion 10*b*. The helical groove 40 has at least two turns.

The thickness, height, and the number of turns of the helical portion 41 are equal to those of the helical groove 40.

Figure 11:
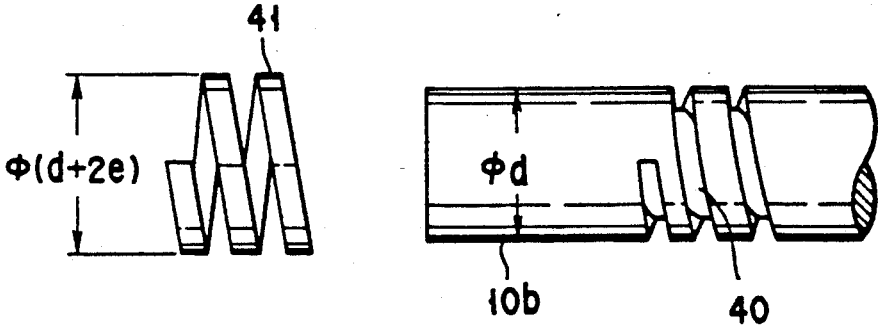

As is shown in FIG. 11, where the diameter of the shaft portion 10*b* is $\phi d$, the outer diameter $\phi$ of the helical portion 41 is $(d+2e)$.

The diameter $\phi d$ of the shaft portion 10*b* is equal to the diameter $\phi D$ of the support holes 44*a*, 44*b* shown in FIG. 9A. The outer diameter $\phi(d+2e)$ of the helical portion 41 is equal to the diameter $\phi(D+2e)$ of the eccentric support portion 42.

Referring back to FIGS. 8 and 9A, a chamfered portion 48 is provided along the peripheral end of the support hole 44*b* at the end face of the sub-bearing 9A.

The chamfered portion 48 has an inclination of 30° to 45° in cross section with respect to its peripheral edge parallel to the diametrical direction of the support hole 44*b*.

It is necessary that the outer diameter $\phi Do$ of the chamfered portion 48 at the end face of the sub-bearing 9A be at least greater than $\phi(d+4e)$. Specifically, the following equation must be established:

$$\phi Do > \phi(d+4e)$$

In assembling the above oil supply device Kc, the helical portion 41 is wound around the helical groove 40 of the shaft portion 10*b* in advance, and then the shaft portion 10*b* is fitted in the sub-bearing 9A.

Specifically, the shaft portion 10*b* is made to face the end-side support hole 44*b* at which the chamfered portion 48 of the sub-bearing 9A is provided. From this state, the shaft portion 10*b* is pushed into the support hole 44*b*, and it is further pushed into the other support hole 44*a* via the eccentric support portion 42. At this time, the helical portion 41, which is, in advance, wound around the helical groove 40 of the shaft portion 10*b*, abuts on the chamfered portion 48.

The outer diameter $\phi(d+2e)$ of the helical portion 41 is equal to the diameter $\phi(D+2e)$ of the eccentric support portion 42, but the maximum outer diameter $\phi Do$ of the chamfered portion 48 at the end face of the sub-bearing 9A is greater than $\phi(d+4e)$. Thus, there is an allowance for the helical portion 41. However, the diameter $\phi D$ of the support hole 44*b* is equal to the diameter $\phi d$ of the shaft portion 10*b*, and each is less than the diameter of the eccentric support portion 42 by 2e. Thus, after the helical portion 41 has passed through the chamfered portion 48, the outer diameter of the helical portion 41 is reduced to $\phi D$.

When the helical portion 41 is passed through the chamfered portion 48, the diameter of the helical portion 41 can be smoothly reduced with low resistance since the chamfered portion 48 is tapered with an angle of 30° to 45°, as stated above.

Furthermore, when the shaft portion 10*b* is inserted, the helical portion 41 is not necessarily be situated to project downward from the rotation shaft 2, as shown in FIG. 10. Inversely, the helical portion 41 may project upward, forward, rearward, or uniformly in the circumferential direction. Even if the helical portion 41 projects in any direction when it is inserted, it can be smoothly inserted since the outer diameter $\phi Do$ of the end face of the chamfered portion 48 is greater than $\phi(d+4e)$.

When the helical portion 41 is situated at the eccentric chamber 49, the shaft portion 10*b* is rotatably supported by both support holes 44*a* and 44*b*.

Accordingly, the sufficient support length for the shaft portion 10*b* can be maintained, and the surface pressure at the ends of the support holes 44*a* and 44*b* is low. Thus, the degree of wear is low.

The helical portion 41 wound around the shaft portion 10*b* rotates with the shaft portion 10*b* as one unit in the eccentric chamber 47.

More specifically, the upper end W of the support holes 44*a* and 44*b* coincides with the upper end W of the eccentric support portion 42. These upper ends W are on the same line with the upper end of the helical portion 41, and by using this line as a boundary line, the helical portion 41 divides the eccentric chamber 47 into the same number of closed chambers as the number of turns of the helical portion 41. Since the helical portion 41 has a helical shape, the boundary line moves in the direction of rotation and accordingly the closed chambers defined by the helical portion 41 gradually move.

The closed chambers divided by the helical portion 41 has a negative pressure, and the lubrication oil in the oil reservoir 17 is sucked up through the suck-up path 43 communicating with the closed chambers.

The lubrication oil is led to the eccentric chamber 49, and the oil is filled in the closed chambers by the rotation of the helical portion 41 and conveyed to the support hole 44*b*.

The pressurized lubrication oil is conveyed from the eccentric chamber 49 to the support hole 44*b*. In particular, the support hole 44*b* is provided with the oil guide groove 45, and the oil is smoothly guided and finally supplied to the compression mechanism (not shown).

Figure 12:
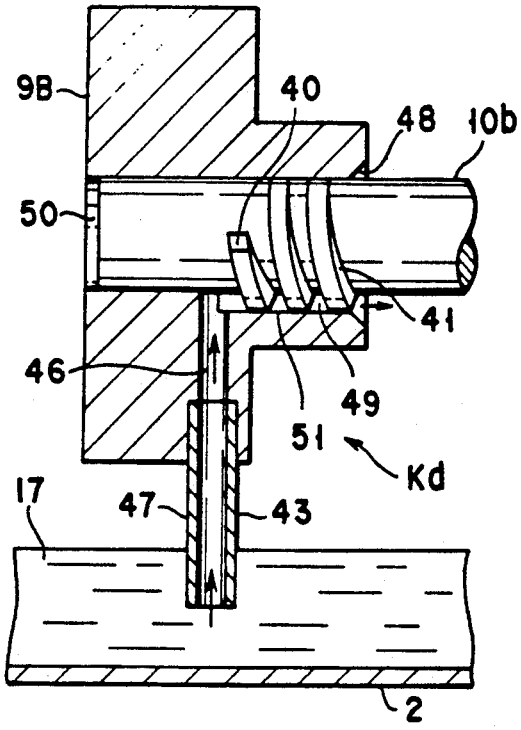
Figure 14:
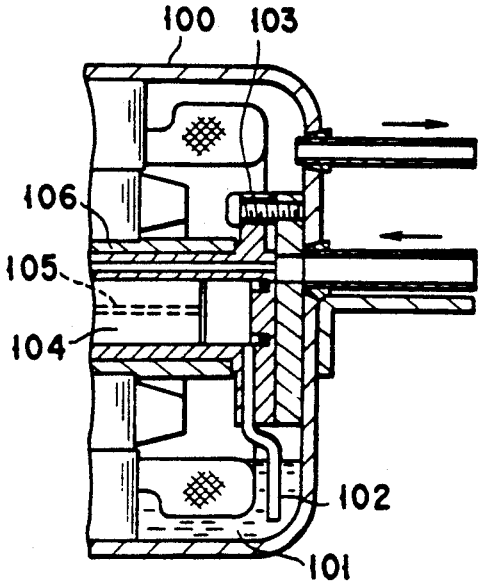
FIG. 14 (PRIOR ART)
FIG. 14 is a vertical cross-sectional view of a conventional oil supply device of a fluid compressor.
Figure 13A:
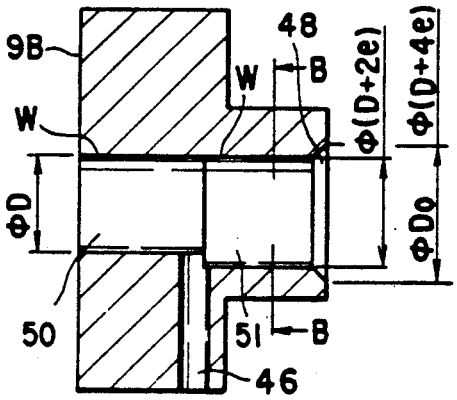
FIG. 13A is a vertical cross-sectional view of a sub-bearing which is a part of the oil supply device.
Figure 13B:
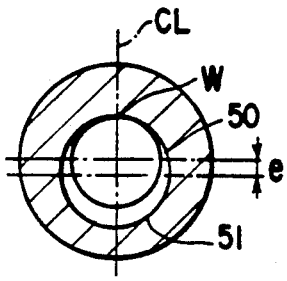
FIG. 13B is a vertical cross-sectional view taken along line B—B in FIG. 13A.

It is also possible to use an oil supply device Kd as shown in FIGS. 12, 13A and 13B.

A sub-bearing 9B of the oil supply device Kd is provided with one support hole 50 and one eccentric support portion 51 adjacent to the support hole 50.

The relationship between the diameter $\phi D$ of the support hole 50 and the diameter $\phi(D+2e)$ of the eccentric support portion 51 is the same as has been described with reference to FIGS. 8 and 9.

The shaft portion 10*b* is rotatably supported in the support hole 50, and the eccentric chamber 49 is formed between the eccentric support portion 51 and the periphery of the shaft portion 10*b*. The helical portion 41 having the outer diameter of $\phi(D+2e)$, which is wound around the shaft portion 10*b*, projects into the eccentric chamber 49. The shaft portion 10*b* serves as a winding portion.

The sub-bearing 9B is provided with the oil supply port 46. The oil supply port 46 and the oil suck-up pipe 47 constitute the oil suck-up path 43.

The chamfered portion 48 is provided along the peripheral end of the eccentric support portion 51 at the end face of the sub-bearing 9B. Like the preceding embodiment, the outer diameter $\phi Do$ of the chamfered portion 48 is greater than $\phi(D+4e)$.

Accordingly, when the helical portion 41 wound around the helical groove 40 is assembled in the sub-bearing 9B, the helical portion 41 is guided by the chamfered portion 48 and the diameter thereof is smoothly decreased. Thus, the assembly is made easier.

In the above embodiments, the compressor of the so-called helical blade type is employed, but other compressors of various types, e.g. reciprocal motion type, rotary type, scroll type, etc., may be used. I brief, the present invention is applicable to any oil supply device employed in a fluid compressor having a horizontal rotation axis.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A fluid compressor having a horizontal rotation axis comprising:

a sealed casing;

an oil reservoir, formed at an inner bottom portion of the sealed casing, for receiving a lubrication oil;

a rotor situation within the sealed casing and supported with its axis situation horizontally, in parallel to the level of the lubrication oil in the oil reservoir at a predetermined distance kept between the rotor and the level of the lubrication oil;

a motor unit, provided on the rotor, for rotating the rotor;

a compression mechanism, providing on the rotor, for sucking, compressing and discharging a fluid to be compressed, in accordance with the rotation of the rotor; and oil supply means, provided on the rotor, for sucking the lubrication oil from the oil reservoir by utilizing a torque of the rotor as a driving force, and forcefully supplying the lubrication oil to a discharge-side slide portion of the compression mechanism said compression mechanism comprising:

a cylinder having open end portions rotatably supported by bearings;

a rotor piston situation within the cylinder and having end shaft portions rotatably supported by the bearings with an eccentricity to the cylinder;

a blade helically wound around the outer periphery of the rotor piston, the blade being able to project from and retreat in the periphery of the rotor piston; and driving means for coupling the cylinder and the rotor piston, rotating together the cylinder and the rotor piston, taking the fluid to be compressed into a working space defined by the cylinder, the rotor piston and the blade, and successively conveying and compressing the fluid, said oil supply means being provided on the at least one of the shaft portions of the rotor piston, within at least one of the bearings supporting the shaft portions, said oil supply means comprising:

at least one winding portion adjoining the shaft portion of the rotor piston;

at least one support hole for supporting the shaft portion of the rotor piston within at least one of the bearings, the support hole adjoining the winding portion;

an eccentric support portion being eccentric to the center axis of the support hole, and having an eccentric chamber being defined between the periphery of the shaft portion and the inner cavity of the bearing;

a helical portion wound around the winding portion of the rotor piston, being able to project from and retreat in the periphery of the winding portion, projecting to the eccentric chamber, and being rotatable with the winding portion as one unit; and an oil suck-up path having one opening end portion, which is open to the eccentric chamber, and the other opening end portion, which is immersed in the lubrication oil in the oil reservoir, wherein in accordance with the rotation of the shaft portion, the helical portion is rotated, and the lubrication oil is sucked up through the oil suck-up path, led to the eccentric chamber and forcefully supplied to the compression mechanism.

2. The compressor according to claim 1, wherein the eccentric support portion is located at the center of the bearing, and the support holes are located on both sides of the eccentric support portion.

3. The compressor according to claim 2, wherein the support hole located at a position, to which the lubrication oil is supplied by the helical portion, has an oil guide groove for guiding the lubrication oil axially along the periphery of the support hole.

4. The compressor according to claim 2, wherein a chamfered portion is provided along the peripheral end of at least one of the support holes at the end face of the bearing, and the winding portion with the helical portion wound is inserted from the chamfered portion at the time of assembly.

5. The compressor according to claim 1, wherein the bearing is provided with one eccentric support portion and one support hole which adjoin each other, and a chamfered portion is provided along the edge of the eccentric support portion, and the winding portion with the helical portion wound is inserted from the chamfered portion at the time of assembly.

6. The compressor according to claim 1, wherein said compression mechanism comprises:

a cylinder having open end portions rotatably supported by bearings;

a rotor piston situation within the cylinder and having end shaft portions rotatably supported by the bearings with an eccentricity to the cylinder;

a pair of blades helically wound around the outer periphery of the rotor piston from the axial center of the rotor piston in opposite directions, the blades being able to project from and retreat in the periphery of the rotor piston; and driving means for coupling the cylinder and the rotor piston, rotating the cylinder and the rotor piston relative to each other, taking the fluid to be compressed into a pair of working spaces defined by the cylinder, the rotor piston and the blades, and successively conveying and compressing the fluid.

7. The compressor according to claim 6, wherein said oil supply means is provided in both shaft portions of the rotor piston, within the bearings supporting the shaft portions.

* * * * *